US011009816B2

(12) United States Patent
Ishizumi et al.

(10) Patent No.: US 11,009,816 B2
(45) Date of Patent: May 18, 2021

(54) ELECTROPHOTOGRAPHIC BELT AND ELECTROPHOTOGRAPHIC IMAGE FORMING APPARATUS

(71) Applicant: CANON KABUSHIKI KAISHA, Tokyo (JP)

(72) Inventors: Keisuke Ishizumi, Hiratsuka (JP); Takayuki Tanaka, Tokyo (JP); Koujirou Izumidate, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/847,491

(22) Filed: Apr. 13, 2020

(65) Prior Publication Data

US 2020/0341410 A1 Oct. 29, 2020

(30) Foreign Application Priority Data

Apr. 25, 2019 (JP) ..... JP2019-084092

(51) Int. Cl.
*G03G 15/01* (2006.01)
*G03G 15/16* (2006.01)

(52) U.S. Cl.
CPC ..... *G03G 15/1685* (2013.01); *G03G 15/161* (2013.01); *G03G 15/168* (2013.01)

(58) Field of Classification Search
CPC ..... G03G 15/1685; G03G 15/161; G03G 15/168; G03G 15/162
See application file for complete search history.

(56) References Cited

U.S. PATENT DOCUMENTS 5,519,475 A * 5/1996 Miyamoto ..... G03G 15/1605 399/308
6,643,487 B1 11/2003 Shimmura
8,929,784 B2 * 1/2015 Takazawa ..... G03G 15/162 399/303
2003/0002892 A1 1/2003 Saito et al.
2015/0177653 A1 6/2015 Seki et al.

FOREIGN PATENT DOCUMENTS

JP 2005082327 A 3/2005
JP 2010191232 A 9/2010
JP 2016186582 A 10/2016

OTHER PUBLICATIONS

Unpublished U.S. Appl. No. 16/699,835.

(Continued)

*Primary Examiner* — Hoang X Ngo
(74) *Attorney, Agent, or Firm* — Canon U.S.A., Inc. I.P. Division

(57) ABSTRACT

An endless-shaped electrophotographic belt with a cleaning blade provides improvement in transfer remaining toner wiping properties. The electrophotographic belt has an endless shape including, on an outer circumferential surface thereof, grooves and lands. The grooves extend in a circumferential direction of the belt and the lands are positioned between the grooves. The belt further has on the outer circumferential surface, one or more convex portion(s) between at least one of the grooves and one of the lands adjacent to the one of the grooves, and in a cross section of the belt in a direction orthogonal to a direction of which the grooves extend, the convex portion(s) projects more than the lands.

5 Claims, 7 Drawing Sheets

(56) References Cited

OTHER PUBLICATIONS

Jun Zhang et al, Fabrication of thin-film organic transistor on flexible substrate via ultraviolet transfer embossing, Applied Physics Letters, vol. 90, No. 24, Jun. 2007, pp. 243502-243502.
Zhifu Yin et al., A novel bonding method for fabrication of PMMA nanofluidic chip with low deformation of the nano-trenches, Microfluidics and Nanofluidics, vol. 22, No. 9, Aug. 2018, pp. 1-10.

* cited by examiner

ELECTROPHOTOGRAPHIC BELT AND ELECTROPHOTOGRAPHIC IMAGE FORMING APPARATUS

BACKGROUND OF THE DISCLOSURE

Field of the Disclosure

The present disclosure relates to an electrophotographic belt used as an intermediate transfer member or the like in an electrophotographic image forming apparatus such as an electrophotographic apparatus, and an electrophotographic image forming apparatus including the electrophotographic belt.

Description of the Related Art

Electrophotographic image forming apparatuses, for which an electrophotographic process is adopted, so-called electrophotographic apparatuses, include an apparatus of a system in which a toner image is transferred directly onto a transfer material (paper, OHT sheet, etc.) from a photosensitive member for electrophotography, and an apparatus of an intermediate transfer system. The intermediate transfer system is a system in which a toner image is primarily transferred from a photosensitive member onto an intermediate transfer member, and then secondarily transferred from the intermediate transfer member onto a transfer material.

There is a need in an electrophotographic apparatus of the intermediate transfer system reliably wiping (removing) toner that is not secondarily transferred completely but remains on an intermediate transfer member (hereinafter, referred to as "transfer remaining toner"). One of known systems for wiping transfer remaining toner on an intermediate transfer member is a system in which the transfer remaining toner is scraped off to be removed with a cleaning blade that is an elasticity body arranged abutting against a surface of an intermediate transfer member (hereinafter, referred to as "blade cleaning system"). A widely used intermediate transfer member is one in a belt shape, that is, an electrophotographic belt.

As a technique to improve a cleaning performance in the blade cleaning system, Japanese Patent Application Laid-Open No. 2005-82327 discloses a technique that makes an endless belt being an intermediate transfer member have a surface roughness of 0.2 to 0.6 μm in terms of 10 point average roughness, by providing an outer circumferential surface of the belt with grooves extending in a longitudinal direction of the belt.

However, the electrophotographic belt according to Japanese Patent Application Laid-Open No. 2005-82327 experiences a case where, as a result of long term use, transfer remaining toner begins to slip through a cleaning blade, decreasing its wiping properties.

The endless belt according to Japanese Patent Application Laid-Open No. 2005-82327 may be used as an intermediate transfer member to test a cleaning performance of the endless belt, with the blade cleaning system adopted. As a result, transfer remaining toner on the endless belt is removed by the cleaning blade in an early stage. It is however found that the transfer remaining toner slips through an abutment portion between the cleaning blade and the endless belt in some cases after long term use due to wearing of the abutment portion between the cleaning blade and the endless belt proceeds by so-called stick slip. Here, the stick slip refers to a phenomenon in which the abutment portion between the cleaning blade and the endless belt is elongated in a rotating direction of the endless belt, and the abutment portion slips to return in an opposite direction to the rotating direction after reaching its limit of elongation. The worn cleaning blade increases its surface adhered to the endless belt as well as its slip distance, and therefore fails to obtain a sufficient abutment load in slipping, making it easy for the transfer remaining toner to slip through the abutment portion.

SUMMARY OF THE DISCLOSURE

An aspect of the present disclosure is directed to providing an electrophotographic belt that is excellent in transfer remaining toner wiping properties with a cleaning blade.

Another aspect of the present disclosure is directed to providing an electrophotographic image forming apparatus capable of forming a high-grade electrophotographic image stably.

According to an aspect of the present disclosure, there is provided an electrophotographic belt having an endless shape, the electrophotographic belt comprising, on an outer circumferential surface thereof, grooves and lands, the grooves extending in a circumferential direction of the belt, the lands being positioned between the grooves, wherein the belt further has on the outer circumferential surface, one or more convex portion(s) between at least one of the grooves and one of the lands adjacent to the one of the grooves, and in a cross section of the belt in a direction orthogonal to a direction of which the grooves extend, the convex portion(s) projects more than the lands.

According to another aspect of the present disclosure, there is provided an electrophotographic image forming apparatus comprising an electrophotographic belt and a cleaning blade configured to abut against an outer circumferential surface of the belt, the cleaning blade is so provided as to intersect with the grooves at an abutment nip of the cleaning blade and the outer circumferential surface of the belt the electrophotographic belt.

Further features and aspects of the present disclosure will become apparent from the following description of exemplary embodiments with reference to the attached drawings.

DESCRIPTION OF THE EMBODIMENTS

Embodiments, features and aspects of the present disclosure will now be described in detail in accordance with the accompanying drawings.

First, an electrophotographic belt according to an aspect of the present disclosure will be described with reference to the drawings. Note that, in the following description, surface roughnesses Rz and average distances Sm of concaves and convexes are both measured in accordance with Japanese Industrial Standards (JIS) B0601 (2001).

The electrophotographic belt according to the present disclosure is used as an intermediate transfer member in an electrophotographic image forming apparatus such as an electrophotographic apparatus. An electrophotographic image forming apparatus including the electrophotographic belt according to the present disclosure is provided with a cleaning blade that abuts against a surface of this electrophotographic belt to remove transfer remaining toner. The electrophotographic belt according to the present disclosure includes a surface on which a plurality of grooves are formed extending in a direction that intersects an abutment nip of the cleaning blade.

One aspect of the disclosure provides a solution on how to reduce slip-through of the transfer remaining toner and blade wearing due to the stick slip described above, by making a shape of an outer circumferential surface of an electrophotographic belt into a specific shape is herein disclosed below.

Figure 1A:
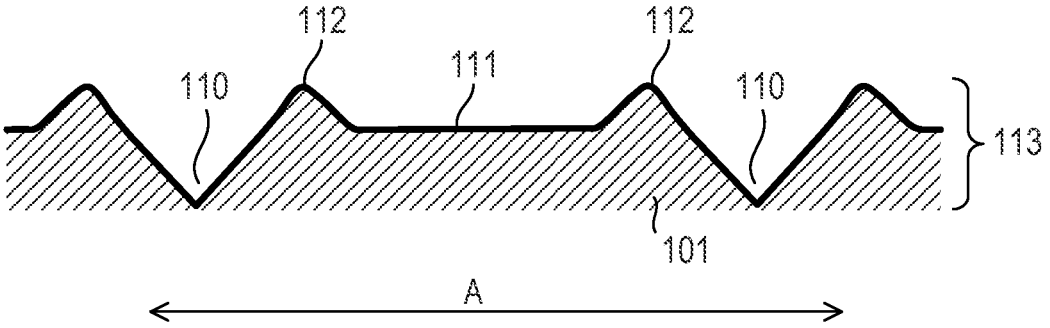
FIGS. 1A, 1B, and 1C are schematic cross-sectional views each illustrating configuration examples of surfaces of belts for electrophotography according to the present disclosure.
Figure 1B:
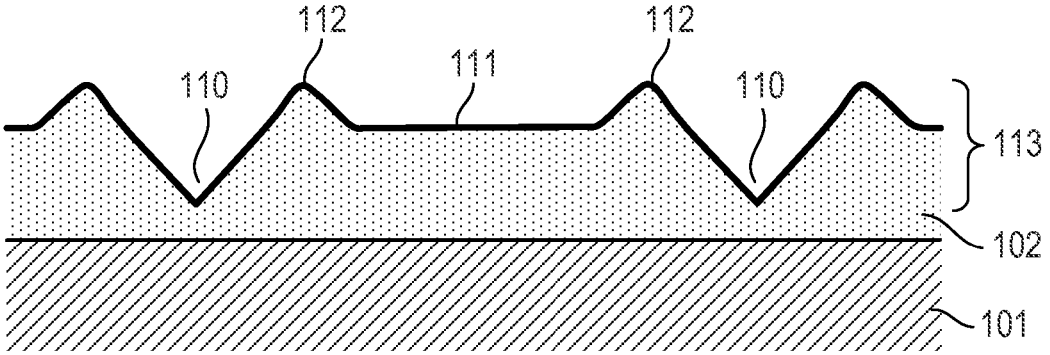
Figure 1C:
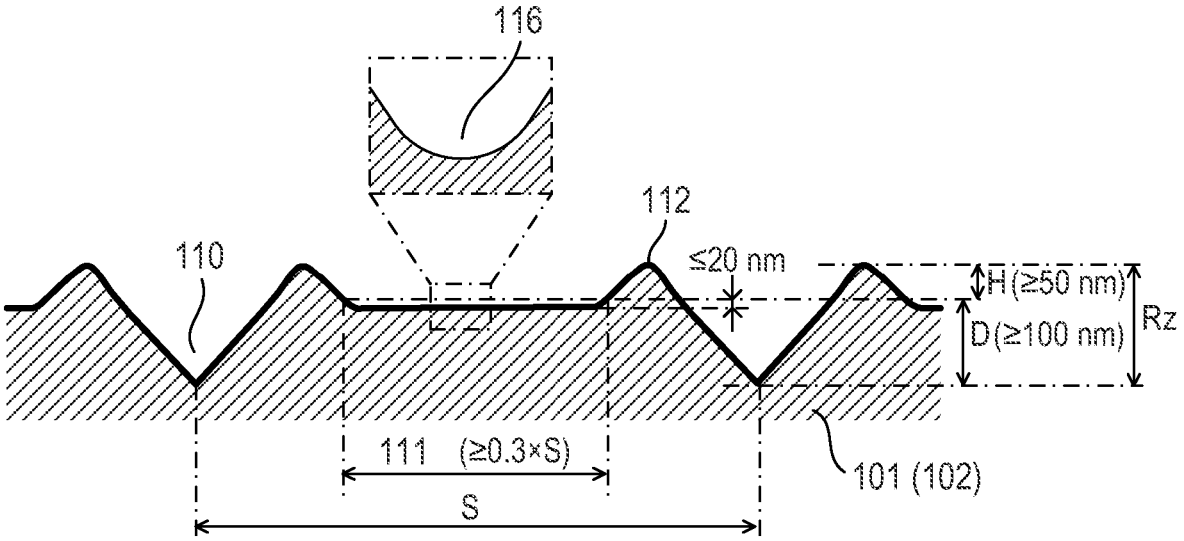

As illustrated in FIG. 1A to FIG. 1C, the disclosure provides formation of a land 111 at a position between every adjacent two grooves 110, and formation of convex portions 112 between the land 111 and the two grooves 110 adjacent to the land 111.

Here, the lands 111 and the convex portions 112 appear on the outer circumferential surface of the electrophotographic belt in a cross section of the electrophotographic belt on a plane orthogonal to a direction in which a plurality of grooves 110 extend, and the convex portions 112 project more than the land 111. The convex portions 112 each have a ridge-line shape that extends in parallel to the direction in which the grooves 110 extend. Since the belt has the outer surface with afore-mentioned profile, at the time when a cleaning blade 11 is brought into contact with the outer surface of the belt 5, a nip is created between the land 111 and the cleaning blade 11, and the nip prevents transfer remaining toner on the outer surface of the belt from slip-through.

In addition, the grooves 110 extending on the outer circumferential surface of the electrophotographic belt 5 can reduce a frictional resistance produced between the cleaning blade 11 and the electrophotographic belt 5. Furthermore, the cleaning blade 11 is lifted by the ridge-line-shaped convex portions 112 higher than the lands 111 adjacent to the extending grooves 110, which can restrain excessive adhesion (stick) to the electrophotographic belt 5. As a result, occurrence of the stick slip is prevented.

As is apparent from Examples described below, let S denote a distance between every closest grooves 110, the lands 111 can each have a length of 0.3×S or more in the direction orthogonal to the direction in which the grooves 110 extend.

The cleaning blade 11 is lifted by the ridge-line-shaped convex portion 112 higher than the lands 111. Here, the convex portion 112 is disposed at least one side of the land 111. In the present disclosure, when the lands 111 are positioned between the grooves 110, it is only required that, for at least one of the grooves 110, a convex portion 112 is formed between the one groove 110 and a land 111 adjacent to the one groove 110. In the configuration illustrated in FIG. 1A to FIG. 1C, the convex portions 112 are provided on both sides of each land 111, but for example, the convex portions 112 may be provided on single sides of the lands 111. However, in order to prevent the wearing of the blade and provide particularly durability, the convex portions 112 can be formed on both sides of the grooves 110, as will be described below.

Figure 2:
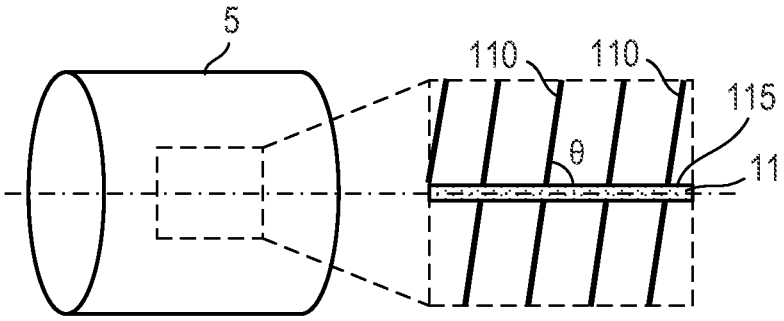
FIG. 2 is a diagram used for describing an angle of concaves and convexes constituting a surface of the electrophotographic belt.

In the electrophotographic belt illustrated FIG. 1A to FIG. 1C, an angle θ formed by the direction in which the grooves 110 extend and a longitudinal direction of an abutment nip 115 made by the cleaning blade 11 in the electrophotographic image forming apparatus can be a right angle or close to the right angle. FIG. 2 illustrates a surface of the electrophotographic belt 5 in an enlarging manner, illustrating this angle θ. An angle close to the right angle means that an angle is 60° or larger and 90° or smaller. The angle θ is more preferably set at 71° or larger and 90° or smaller, still more preferably from 85° to the right angle. By specifying the angle θ having such a value, a force by which the abutment nip of the cleaning blade 11 climbs over a side wall portion constituting a convex portion 112 higher than the lands 111 is kept low. It is considered that this reduces the wearing of the nip portion of the cleaning blade 11, restrains the slip-through of transfer remaining toner reliably for a long time, and can attain a good blade cleaning property.

An example embodiment of the present disclosure will be described below more in detail, but the present disclosure is not limited to this embodiment.

<Example Electrophotographic Image Forming Apparatus>

Figure 3:
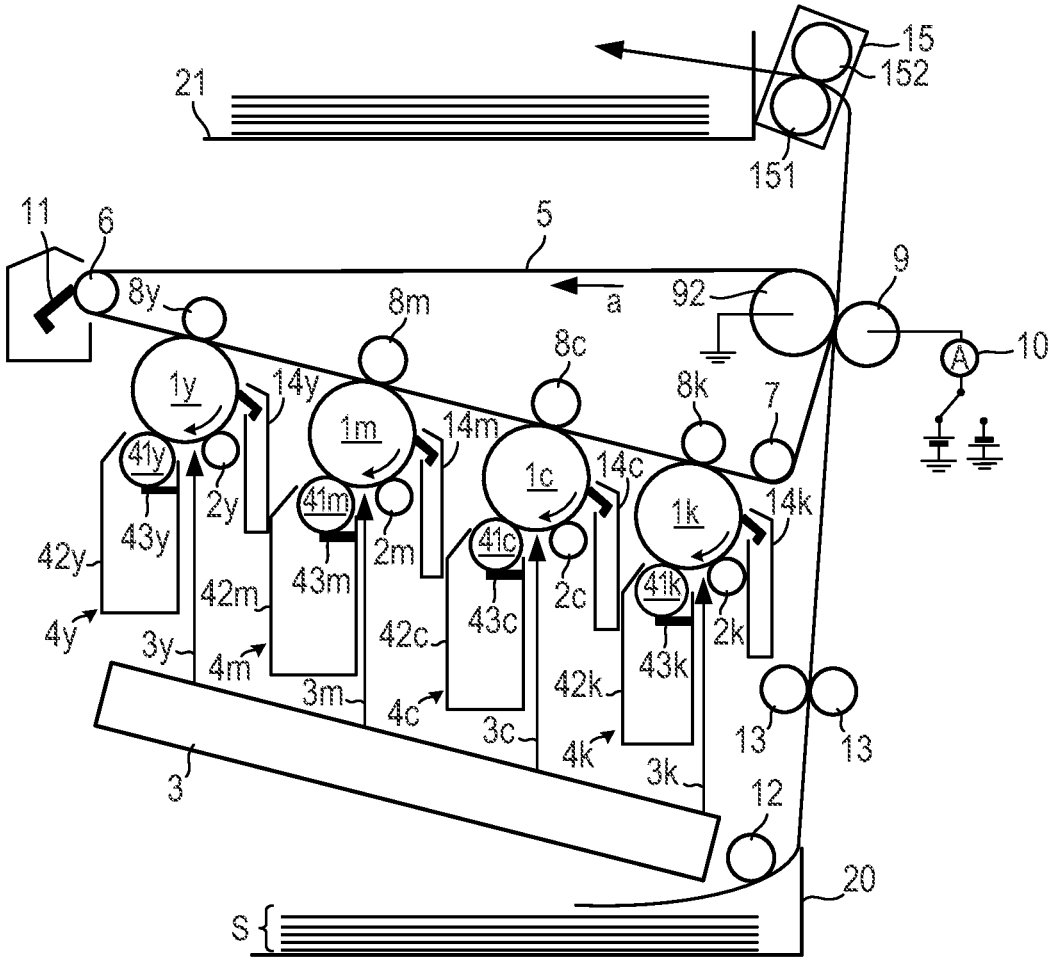
FIG. 3 is a diagram illustrating an example of a configuration of an electrophotographic image forming apparatus of an intermediate transfer system.

FIG. 3 illustrates an example of an electrophotographic image forming apparatus equipped with an electrophotographic belt according to the present disclosure as an intermediate transfer member, and the electrophotographic image forming apparatus is configured in a form of an electrophotographic apparatus. This electrophotographic image forming apparatus is an electrophotographic image forming apparatus that uses four colors of toner expressed as C, Y, and K to form a color image on a recording medium S such as a sheet of paper fed from a paper feeding cassette 20, and includes image forming stations for the respective colors installed adjacent to one another in a substantially horizontal direction. An average particle diameter of the toner is 6 μm, and a particle size distribution of the toner can be regarded substantially as a normal distribution, and a toner having a particle diameter of 2 μm or smaller accounts for 1% of the particle size distribution.

The image forming stations for the respective colors include photosensitive drums 1*c*, 1*m*, 1*y* and 1*k*, respectively. Each of indices "c", "m", "y" and "k" following each reference numeral herein indicates an image forming station of what color a member followed by the reference numeral with the index belongs to. The electrophotographic image forming apparatus is provided with a scanner 3 being a laser optical unit, from which laser light beams 3*c*, 3*m*, 3*y* and 3*k* corresponding to image signals of the colors are radiated toward the photosensitive drums 1*c*, 1*m*, 1*y* and 1*k*, respectively. The image forming stations all have the same structure, and thus the image forming station for the color K will be described here. Surrounding the photosensitive drum 1*k*, a conductive roller 2*k* being a contact electrostatic-charging device, a developing device 4*k*, a conductive roller 8*k* being a primary transfer roller, and a blade 14*k* used for wiping the photosensitive drum 1*k* are arranged. The developing device 4*k* is provided with a developer roller 41*k* being a developer bearing member that develops a latent image on the photosensitive drum 1*k*, a developer container 42*k* that retains toner to be supplied to the developer roller 41*k*, and a developing blade 43*k* that regulates an amount of toner on the developer roller 41*k* and applies electrical charge to the developer roller 41*k*.

The electrophotographic belt 5 is configured as a belt having an endless shape, is provided to all of the image forming stations of the colors, is looped around an opposing roller 92, a tension roller 6, and a driving roller 7, and is rotated in a direction of an illustrated arrow a by the driving roller 7. In a section between the tension roller 6 and the driving roller 7, the electrophotographic belt 5 comes into contact with surfaces of the photosensitive drums 1*c*, 1*m*, 1*y* and 1*k* one after another, and pressed against the photosensitive drums 1*c*, 1*m*, 1*y* and 1*k* by conductive rollers 8*c*, 8*m*, 8*y* and 8*k*.

This causes a toner image formed on the surfaces of the photosensitive drums 1*c*, 1*m*, 1*y* and 1*k* to be transferred onto the surface of the electrophotographic belt 5 being an intermediate transfer member. Being opposed to the opposing roller 92, a secondary transfer roller 9 is provided, and the secondary transfer roller 9 presses the electrophotographic belt 5 against the opposing roller 92.

To the secondary transfer roller 9, a secondary transfer voltage is applied from an electric power source via a current sensing circuit 10. The secondary transfer roller 9 and the opposing roller 92 constitute a secondary transfer unit. The recording medium S passes via a feeding roller 12 and conveyance rollers 13 and through a nip portion between the electrophotographic belt 5 and the secondary transfer roller 9 at a position of the opposing roller 92, by which a toner image retained on the outer circumferential surface of the electrophotographic belt 5 is transferred onto the recording medium S. This forms an image on the surface of the recording medium S. The recording medium S onto which the toner image is transferred passes a fuser 15 constituted by a pair of rollers: a heating roller 151 and a pressing roller 152, by which the image is fused on the recording medium S, and the recording medium S is ejected to an output tray 21. At a position of the tension roller 6, the cleaning blade 11 that abuts against the outer circumferential surface of the electrophotographic belt 5 is provided. Toner that is not transferred onto the recording medium S but remains on the outer circumferential surface of the electrophotographic belt 5 is to be scraped off to be removed by the cleaning blade 11. The cleaning blade 11 is a member extending in a direction that is substantially orthogonal to a moving direction of the electrophotographic belt 5.

<Example Electrophotographic Belt>

The electrophotographic belt having an endless shape according to the present disclosure includes, as illustrated in FIG. 1A, the lands 111, the convex portions 112 projecting more than the lands 111, and the grooves 110 extending parallel to each other, on a surface on a side facing the photosensitive drums, namely, the outer circumferential surface of the electrophotographic belt. FIG. 1A illustrates a cross section of the electrophotographic belt on a plane that is parallel to the outer circumferential surface of the electrophotographic belt and orthogonal to a direction in which the grooves 110 extend. The lands 111 are provided to provide a nip which is formed with the cleaning blade abutting against the outer circumferential surface of this electrophotographic belt. The grooves 110 reduce a frictional resistance produced between the blade and the electrophotographic belt. The convex portions 112 are provided to restrain stick slip of the blade. The grooves 110, the lands 111 and the convex portions 112 constitute a concave-convex shape 113 on the outer circumferential surface of the electrophotographic belt. In order to provide a stable nip, a surface roughness Rz of the concave-convex shape 113 can be 0.2 μm or higher and 0.6 μm or lower. The concave-convex shape 113 illustrated in FIG. 1A is formed directly on a base layer 101 of the electrophotographic belt. The grooves 110 are provided so as to extend in a direction that intersects the abutment nip 115 of the cleaning blade 11 (see FIG. 2). The lands 111 are each positioned between two of the adjacent grooves as a flat area having a surface whose surface roughness is not more than a specified value which will be mentioned later.

Known machining methods for forming fine concaves and convexes include grinding machining, cutting machining, imprinting processing, and the like; for forming the grooves 110, the lands 111, and the convex portions 112 described above, cutting machining, imprinting processing, and the like can be used.

From a viewpoint of a machining cost, a material containing at least a thermoplastic resin can be used for the base layer 101 of the electrophotographic belt, and the imprinting processing can be performed on the outer circumferential surface of this electrophotographic belt.

Examples of a thermoplastic resin material that can be used for the base layer 101 of the electrophotographic belt include polyamide, polyethylene terephthalate, polyethylene naphthalate, polyphenylene sulfide, thermoplastic polyimide, polyether ether ketone, and the like. Two or more of these thermoplastic resin materials can be mixed to be used. The electrophotographic belt according to the present disclosure may have, as illustrated in FIG. 1B, a dual structure, that includes the base layer 101 and a surface layer 102 formed on the base layer 101, and the concave-convex shape 113 may be provided on the surface layer 102. For example, the surface layer 102 can be provided on a side of the electrophotographic belt 5 that is to face and come into contact with the photosensitive drum 1*k* and the cleaning blade 11, from a viewpoint of improving a durability (wear resistance) of the electrophotographic belt 5. For the surface layer 102, a curable resin material, which cures by heat or irradiation with an active energy beam or the like, such as an acrylic material, can be used. In this case, a coating thickness of the surface layer 102 can be less than 3.0 μm, if the coating thickness of the surface layer 102 is not less than 5.0 μm, the grooves 110 sandwiching the lands 111 cannot be fabricated stably, assuming that a thermoplastic material is used for the base layer 101.

Here, in a case where the electrophotographic belt 5 is installed in an electrophotographic image forming apparatus illustrated in FIG. 3, the abutment nip of the cleaning blade 11 is not parallel to a circumferential direction of the electrophotographic belt 5 due to a function of the abutment nip being to remove toner. Therefore, examples of the electrophotographic belt 5 according to the present disclosure include an electrophotographic belt in which grooves 110 are formed in a direction intersecting a circumferential direction of the electrophotographic belt, and the lands 111 and the convex portions 112 described above are formed in a cross section that is orthogonal to the direction in which the grooves 110 extend.

According to an aspect of the present disclosure, an electrophotographic belt that is excellent in transfer remaining toner wiping properties with a cleaning blade can be provided. In addition, according to another aspect of the present disclosure, an electrophotographic image forming apparatus capable of forming a high-grade electrophotographic image stably can be provided.

EXAMPLES

Next, the present disclosure will be described more specifically with reference to examples and comparative examples. Note that the present disclosure is not limited to the following examples. In the examples and the comparative example, belts for electrophotography were manufactured by a procedure described below, and measurement and evaluation of shapes of the belts for electrophotography were conducted.

(Example Methods for Measuring and Evaluating Shapes)

Methods for measuring and evaluating characteristic values of the belts for electrophotography manufactured in the examples and the comparative examples were as follows. In the following description, a direction that is orthogonal to the direction in which the grooves 110 extend and parallel to an outer circumferential surface of an electrophotographic belt will be referred to as a reference direction. The reference direction is a direction illustrated by an arrow A in FIG. 1A.

(1) Evaluating Lands

As a measurement apparatus for a surface shape, a non-contact three-dimensional surface shape measurement apparatus (Trade name: NewView 6300, from Zygo Corporation) was used, and the surface shape was obtained in a form of a shape that is provided based on low frequency components (measurement modes of the apparatus were set as Filter: Low Pass, Filter Type: Average).

As illustrated in FIG. 1C, in a surface shape of an outer circumferential surface of an electrophotographic belt, concave surface shapes each sandwiched between given convex shapes were regarded as extreme points 116, and zones including these extreme points 116, extending along the reference direction, and each sandwiched between the given convex shapes were set as candidates for a land. Then, of the candidates, a zone that had a height falling within a range of 20 nm from the extreme point 116 in a height direction and continued along the reference direction by 30% or larger of an average distance Sm of concaves and convexes was defined as a land 111.

Therefore, variations of the land 111 in the height direction were within 20 nm. In a case where a value obtained by dividing a length of a zone having variations in the height direction falling within the range of 20 nm (here, the length along the reference direction) by the average distance Sm of the concaves and convexes (hereinafter, referred to as a "land ratio L") is 30% or higher, it can be said that the area is a land 111. The measurement was conducted at eight spots including two spots in a width direction×four spots in a circumferential direction, on an electrophotographic belt that was taken out randomly, and over a zone having an evaluation length of 300 μm for each spot, and based on the measurement, a determination as to the lands was conducted.

With consideration given to normal values of a height H of a convex portion 112 and a depth D of a groove 110, it can be considered that the measurement of the average distance Sm of the concaves and convexes actually provides a distance S between grooves 110, and thus a measured average distance Sm of the concaves and convexes can be treated as the distance S between the grooves 110.

Therefore, a land ratio L of not less than 30% is synonymous with a length of a land 111 in the direction orthogonal to the direction in which the grooves 110 extend (i.e., reference direction) that is as much as 0.3 times or more of the distance S between the grooves 110.

(2) Evaluating Convex Portions

For measuring a height H of convex portions 112 formed on an outer circumferential surface of an electrophotographic belt, the non-contact three-dimensional surface shape measurement apparatus (trade name: New-View 6300, from Zygo Corporation) was used as a measurement apparatus.

The height H is defined as a height from a center of the land 111, and in a case where a portion having a height of 50 nm or higher was found, the portion was defined as a convex portion 112. In a case where there was no land 111, a height from an average line was considered to be the height H, and in a case where a portion having a height H of 50 nm or higher was found, the portion was defined as a convex portion 112. The measurement was conducted at eight spots including two spots in a width direction×four spots in a circumferential direction, on an electrophotographic belt that was taken out randomly, and over a zone having an evaluation length of 300 μm for each spot, and based on the measurement, a determination as to whether a convex portion 112 is present was conducted.

(3) Evaluating Grooves

Grooves were determined based on a difference between the height H and a surface roughness Rz described below. A portion having a depth D of not less than 100 nm was defined as a groove 110.

(4) Evaluating Surface Roughness Rz and Average Distance Sm of Concaves and Convexes For measuring the surface roughness Rz and the average distance Sm of the concaves and convexes, a surface roughness measuring instrument (trade name: SURFCOM 1500SD, from TOKYO SEIMITSU CO., LTD.) was used as a measurement apparatus. Parameters relating to the surface roughness Rz and the average distance Sm of the concaves and convexes conformed to JIS B0601(2001); the measurement was conducted under conditions including a cut-off wavelength of 0.25 mm, a measurement sampling length of 0.25 mm, and a measurement length of 1.25 mm. Here, a ten point height of roughness profile Rz of a surface of an electrophotographic belt and the average distance Sm of the concaves and convexes were measured by scanning a stylus of the measuring instrument on an outer circumferential surface of the electrophotographic belt in a direction orthogonal to a direction in which ridge-line-shaped convex portions 112 or grooves 110 extend, namely, in the reference direction. This measurement was conducted at eight spots including two spots in a width direction×four spots in a circumferential direction, on an electrophotographic belt that was taken out randomly, and obtained values are averaged and treated as the surface roughness Rz and the average distance Sm of the concaves and convexes. In a case where neither convex portion 112 nor groove 110 was recognized on the outer circumferential surface of the electrophotographic belt, the evaluation described above was conducted in a direction orthogonal to a rotary drive direction of the electrophotographic belt.

(5) Evaluating Angles of Grooves or Convex Portions

An angle formed by a direction in which grooves 110 or convex portions 112 extend and an abutment nip 115 of a cleaning blade 11 (see FIG. 2) was measured. A non-contact three-dimensional surface shape measurement apparatus (Trade name: NewView 6300, from Zygo Corporation) was used as a measurement apparatus, and a surface shape was obtained in a form of a shape that is provided based on low frequency components (measurement modes of the apparatus were set as Filter: Low Pass, Filter Type: Average). Of Angles formed by an extending direction of the abutment nip 115 of the cleaning blade 11 and an extending direction of the grooves 110 or the convex portions 112 when an electrophotographic belt is attached to an electrophotographic image forming apparatus, smaller one (an angle of not more than 90°) was defined as an angle θ of the grooves 110 or the convex portions 112. The measurement was conducted at eight spots including two spots in a width direction×four spots in a circumferential direction, on an electrophotographic belt that was taken out randomly, and over a zone having an evaluation length of 300 μm for each spot, and based on the measurement, an evaluation of the angle was conducted.

(6) Evaluating Cleaning Performance of the Belt

An electrophotographic image forming apparatus having the configuration illustrated in FIG. 3 with the belt installed as an intermediate transfer belt was prepared, and blade cleaning was performed to evaluate a cleanability of the belt. This evaluation was conducted under an environment at a temperature of 25° C. and a relative humidity of 50%, and A4-sized sheet of paper (Trade name: Extra, manufactured by Canon Production Printing Co., Ltd) was used as a recording media S.

Specifically, the evaluation of the belt was conducted by outputting 250000 of A4-sized sheets of paper on each of which "E-letter image" was formed. The "E-letter image" includes an alphabet characters "E" with a size of 6 point drawn with yellow, magenta, cyan and black toners so that the densities with respective toners were 1%. During the outputting of 250000 sheets, at the every time of 100000 sheet-output, 150000 sheet-output, 175000 sheet-output, 200000 sheet-output and 250000 sheet-output, the following procedures were conducted.

(i) First, an electrophotographic image forming process for forming a solid red toner image was conducted by using yellow and magenta toners while a second transfer bias was not applied, i.e. a second transfer bias=0V. As a result of this procedure, a solid red toner image was formed on an outer surface of the belt, but since the second transfer bias was not applied, the solid red toner image on the belt was not transferred to a sheet of paper. Thus, the solid red image on the belt was conveyed to a nip of the cleaning blade and the outer surface of the belt, and at the nip point, cleaning process for removing the solid red toner image was conducted.

(ii) Next, 3 of A4-sized sheets of paper were passed while a second transfer bias was applied.

In the case that the solid red toner image on the belt was completely removed in the step (i), any toner is not transferred to the sheets passed in the step (ii), but in the case that the solid red toner image on the belt is not fully cleaned, a toner remained on the belt is transferred to at least one of the sheets passed in the step (ii). That is, the cleanability of the belt can be evaluated by observing the sheets passed in the step (ii) whether or not toner is transferred.

In this evaluation, the observation results of the output sheets in the step (ii), i.e. total 15 sheets, were rated in accordance with the following five ranks.

Rank S: poor cleaning was not occurred even at the time when 250000 sheets were output.

Rank A: poor cleaning was not occurred at the time when 200000 sheets were output.

Rank B: poor cleaning was not occurred at the time when 175000 sheets were output.

Rank C: poor cleaning was not occurred at the time when 150000 sheets were output.

Rank D: poor cleaning was occurred at the time when 150000 sheets were output.

As the cleaning blade 11, one having a hardness degree of 77° according to HS K6253 standard was used. Conditions for attaching the cleaning blade 11 included a set angle ϕ of 24°, an intrusion amount δ of 1.5 mm, and an abutting pressure of the cleaning blade 11 of 0.6 N/cm. The set angle ϕ refers to an angle that is formed by the cleaning blade 11 and a tangent plane of the tension roller 6 at an intersection point of the electrophotographic belt 5 and the cleaning blade 11, and the intrusion amount δ refers to a length in a thickness direction for which the cleaning blade 11 overlaps with the tension roller 6.

Example 1

An electrophotographic belt made of a base layer 101 illustrated in FIG. 1A was fabricated. First, a polyethylene naphthalate resin was subjected to blow molding to be formed into a bottle-shaped, molded body, which was cut by an ultrasonic cutter to be formed into an endless belt body. The polyethylene naphthalate resin contained a quaternary ammonium salt (tetrabutylammonium hydrogen sulfate) as a resistance adjustment agent. In this manner, a polyethylene-naphthalate-resin belt having a thickness of 70 μm (glass transition temperature: approximately 120° C.) was obtained.

Figure 4:
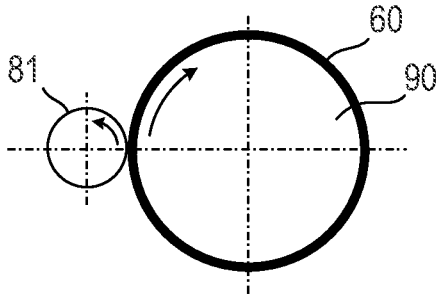
FIG. 4 is a diagram illustrating a configuration of a machining device for forming concaves and convexes on a surface of an electrophotographic belt.

Next, surface shape machining was performed on a resin-made belt 60 with a machining device illustrated in FIG. 4. This machining device is configured to allow the resin-made belt 60 to be disposed around an outer circumference of a column-shaped core 90, to press a mold 81 against the resin-made belt 60, and to allow the mold 81 and the core 90 to rotate in directions illustrated by arrows.

The resin-made belt 60 (circumferential length 712 mm, width 260 mm) was press-fitted to the core 90 (diameter 227 mm, metallic). Thereafter, a pressing force (abutting surface pressure 8.0 MPa) was applied to the mold 81, of which a surface was heated to 130° C. and which includes a plurality of triangular convex portions extending parallel to a circumferential direction, to cause this mold 81 to abut against the resin-made belt 60 in such a manner that axis center lines of the resin-made belt 60 and the mold 81 are parallel to each other. The mold 81 was metallic and had a diameter of 50 mm, a convex height of 3.5 μm, a convex bottom width of 2.0 μm, a convex crest width of 0.2 μm, and an inter-convex distance of 20 μm. This mold will be referred to as a mold A. The heating temperature, 130° C., is higher than the glass transition temperature of the resin-made belt 60 made of polyethylene naphthalate, by 5 to 15° C. Thereafter, the surface shape machining was performed on the resin-made belt 60 by rotating the core 90 once at a circumferential speed of 264 mm/sec and thereby driving the mold 81 while causing the core 90 to abut against the resin-made belt 60.

A surface of the resin-made belt 60 obtained by the surface shape machining had an average distance Sm of concaves and convexes of 20.2 μm and a surface roughness Rz of 0.60 μm.

A depth D of grooves formed by the surface shape machining was 465 nm, which was not less than 100 nm, and thus it is determined that grooves 110 were formed. A land ratio L of lands formed on the surface was 37%, which was not less than 30%, and thus it is determined that lands 111 were formed.

A height H measured on the surface was 130 nm, which was not less than 50 nm, and thus it is determined that convex portions 112 were formed. The resin-made belt 60, of which the surface shape was machined in this manner, was treated as an electrophotographic belt, and this electrophotographic belt was installed as an intermediate transfer member in an electrophotographic image forming apparatus illustrated in FIG. 3, and cleaning evaluation was conducted. At that time, in the electrophotographic image forming apparatus, a direction of an abutment nip formed by the cleaning blade 11 and the electrophotographic belt 5 and an extending direction of the grooves 110 on the surface of the electrophotographic belt 5 formed an angle θ of 90°. The electrophotographic belt 5 in this embodiment caused no poor cleaning at a time of feeding 250000 of recording media, and thus rated as an electrophotographic belt of the Grade S.

Results of the above are shown in Table 1. In Table 1, columns of GROOVE, LAND, and CONVEX PORTION respectively indicate whether the grooves 110, the lands 111, and the convex portions 112 according to the definitions described above were present.

In a column of CLEANING EVALUATION, "G" and "NG" for each number of sheets fed indicate the poor cleaning not occurring ("G") and the poor cleaning occurring ("NG"), respectively.

Example 2

As the mold 81, a mold that was metallic and had a diameter of 50 mm, a convex height of 2.5 μm convex bottom width of 2.0 μm, a convex crest width of 0.2 μm, and an inter-convex distance of 20 μm was used. This mold will be referred to as a mold B. A resin-made belt 60 was fabricated in the same manner as in Example 1 except that the mold B was used, and the same evaluation as in Example 1 was conducted. Results of the evaluation are shown in Table 1.

Example 3

As the mold 81, a mold that was metallic and had a diameter of 50 mm, a convex height of 1.5 μm convex bottom width of 2.0 μm, a convex crest width of 0.2 μm, and an inter-convex distance of 20 μm was used. This mold will be referred to as a mold C. A resin-made belt 60 was fabricated in the same manner as in Example 1 except that the mold C was used, and the same evaluation as in Example 1 was conducted. Results of the evaluation are shown in Table 1.

Example 4

As the electrophotographic belt, as illustrated in FIG. 1B, an electrophotographic belt in which a surface layer 102 was formed on a base layer 101 was fabricated. As the base layer 101, the same belt body as the endless belt body in Example 1 was used.

To this belt body being the base layer 101, ultraviolet-light-curing acrylic material was applied, and the belt body was irradiated with ultraviolet light. As a result, a curing resin film having a thickness 2.5 μm was formed on a surface of the base layer 101, and the curing resin film was treated as the surface layer 102 of the resin-made belt 60. Then, a surface shape of the surface layer 102 was machined with the mold A used in Example 1 under the same conditions as in Example 1 except that the abutting surface pressure was set at 13.3 MPa. Thereafter, the resultant resin-made belt 60 was treated as the electrophotographic belt in the present example, and the same evaluation as in Example 1 was conducted on the electrophotographic belt. Note that the shape and other factors belong to the surface layer 102. Results of the evaluation are shown in Table 1.

Example 5

A resin-made belt 60 was fabricated in the same manner as in Example 4 except that the mold B described in Example 2 was used as the mold 81, and the same evaluation as in Example 4 was conducted. Results of the evaluation are shown in Table 1.

Example 6

A resin-made belt 60 was fabricated in the same manner as in Example 4 except that the mold C described in Example 3 was used as the mold 81, and the same evaluation as in Example 4 was conducted, Results of the evaluation are shown in Table 1.

Example 7

In Example 7, the same electrophotographic belt as in Examples 4 to 6 was used, but the machining of a surface shape of its surface layer 102 was changed to cutting machining to obtain the electrophotographic belt.

Figure 5A:
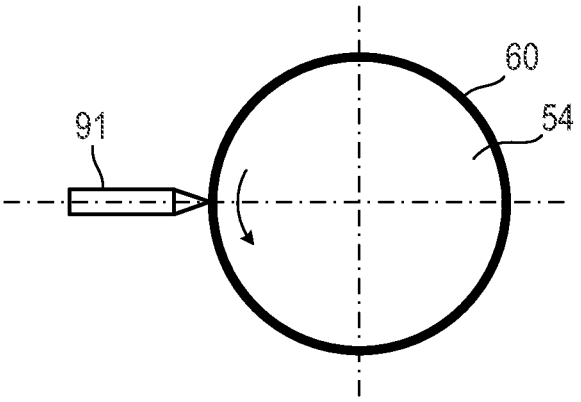
FIGS. 5A, 5B, and 5C are diagrams each illustrating a configuration of a cutting device for forming concaves and convexes on a surface of an electrophotographic belt.
Figure 5B:
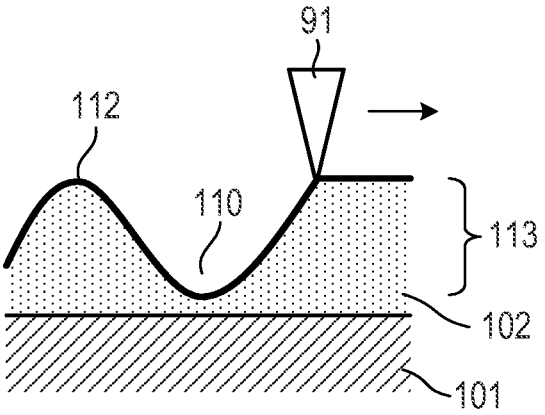
Figure 5C:
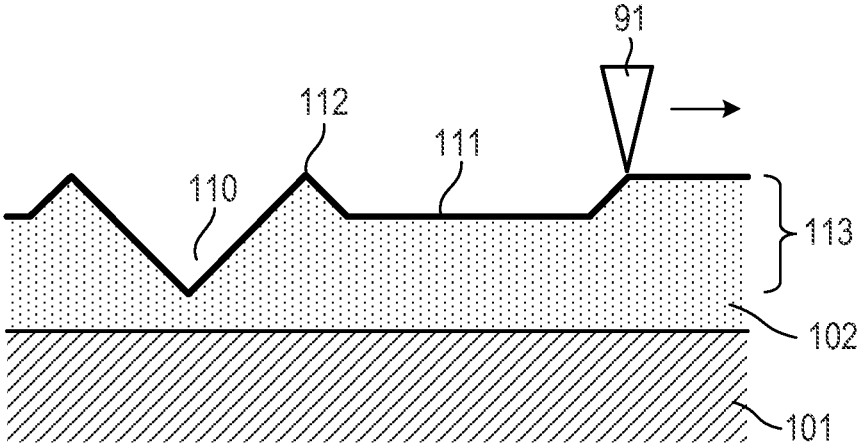

FIG. 5A to FIG. 5C are diagrams for describing a cutting apparatus used in Example 7; FIG. 5A is a schematic diagram of a configuration of the cutting apparatus, FIG. 5B is a cross-sectional view illustrating how to machine a convex portion 112 and a groove 110 with the cutting apparatus, and FIG. 5C is a cross-sectional view illustrating how to machine a groove 110, a convex portion 112, and a land 111. This cutting apparatus includes a cutting bit 91 for cutting a surface of a resin-made belt 60 and is configured to allow the resin-made belt 60 to be disposed around an outer circumference of a column-shaped core 54 and to rotate the core 54 for performing surface machining with the cutting bit 91.

The resin-made belt 60 (circumferential length 712 mm, width 260 mm) was press-fitted to the core 54 (diameter 227 mm, metallic), and the cutting bit 91 (diamond bit, from A.L.M.T. Corp) was caused to abut against the surface of the resin-made belt 60. Thereafter, the core 54 was rotated once at a circumferential speed of 2.2 m/sec, and then the cutting bit 91 was moved in a width direction of the resin-made belt 60 at a feed rate of 0.005 mm/sec with the core 54 caused to abut against the resin-made belt 60. In the surface shape machining, cutting conditions of the cutting bit were controlled in such a manner that the cutting bit can form free-form curves with respect to the width direction of the resin-made belt 60.

After the surface shape machining, the evaluation of the surface shape and the cleaning evaluation were conducted as in Example 4. Results of the evaluation are shown in Table 1.

In Examples 1 to 7, the angle θ formed by the direction in which the grooves 110 formed on each electrophotographic belt extend and the abutment nip of the cleaning blade 11 was set at 90°, namely, the right angle, but in the following embodiments, θ was changed from 90° by changing the mold to be used.

Example 8

As the mold 81, a mold made of metal and having a diameter of 50 mm, a convex height of 2.5 μm, a convex bottom width of 2.0 μm, a convex crest width of 0.2 μm, and an inter-convex distance of 20 μm, and in which an extending direction of its axis center forms an angle of 85° with an extending direction of the convex height, was used. This mold will be referred to as a mold D. A resin-made belt 60 was fabricated in the same manner as in Example 4 except that the mold D was used, and the same evaluation as in Example 4 was conducted, Results of the evaluation are shown in Table 1.

Example 9

As the mold 81, a mold made of metal and having a diameter of 50 mm, a convex height of 2.5 μm, a convex bottom width of 2.0 μm, a convex crest width of 0.2 μm, and an inter-convex distance of 20 μm, and in which an extending direction of its axis center forms an angle of 80° with an extending direction of the projection height, was used. This mold will be referred to as a mold E. A resin-made belt 60 was fabricated in the same manner as in Example 4 except that the mold E was used, and the same evaluation as in Example 4 was conducted. Results of the evaluation are shown in Table 1.

Example 10

As the mold 81, a mold made of metal and having a diameter of 50 mm, a convex height of 2.5 μm, a convex bottom width of 2.0 μm, a convex crest width of 0.2 μm, and an inter-convex distance of 20 μm, and in which an extending direction of its axis center forms an angle of 72° with an extending direction of the convex height, was used. This mold will be referred to as a mold F. A resin-made belt 60 was fabricated in the same manner as in Example 4 except that the mold F was used, and the same evaluation as in Example 4 was conducted. Results of the evaluation are shown in Table 1.

Example 11

As the mold 81, a mold made of metal and having a diameter of 50 mm, a convex height of 2.5 μm convex bottom width of 2.0 μm, a convex crest width of 0.2 μm, and an inter-convex distance of 20 μm, and in which an extending direction of its axis center forms an angle of 68° with an extending direction of the convex height, was used. This mold will be referred to as a mold G. A resin-made belt 60 was fabricated in the same manner as in Example 4 except that the mold G was used, and the same evaluation as in Example 4 was conducted. Results of the evaluation are shown in Table 1.

Example 12

As the mold 81, a mold made of metal and having a diameter of 50 mm, a convex height of 2.5 μm, a convex bottom width of 2.0 μm, a convex crest width of 0.2 μm, and an inter-convex distance of 20 μm, and in which an extending direction of its axis center forms an angle of 60° with an extending direction of the convex height, was used. This mold will be referred to as a mold H. A resin-made belt 60 was fabricated in the same manner as in Example 4 except that the mold H was used, and the same evaluation as in Example 4 was conducted. Results of the evaluation are shown in Table 1.

Example 13

As the mold 81, a mold made of metal and having a diameter of 50 mm, a convex height of 2.5 μm, a convex bottom width of 2.0 μm, a convex crest width of 0.2 μm, and an inter-convex distance of 3.8 μm, and in which an extending direction of its axis center forms an angle of 90° with an extending direction of the convex height, was used. This mold is referred to as a mold I. A resin-made belt 60 was fabricated in the same manner as in Example 4 except that the mold I was used, and the same evaluation as in Example 4 was conducted. Result of the evaluation are shown in Table 1.

Comparative Example 1

Figure 6A:
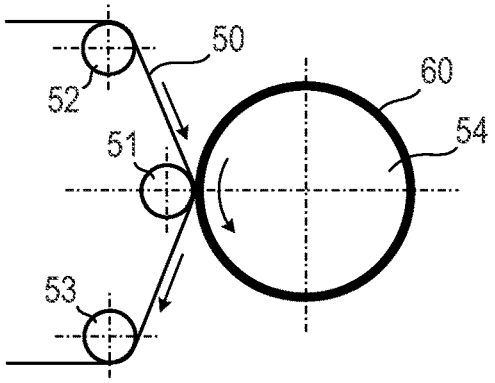
FIGS. 6A, 6B, and 6C are diagrams each illustrating a configuration of a grinding apparatus for forming grooves on a surface of an electrophotographic belt.
Figure 6B:
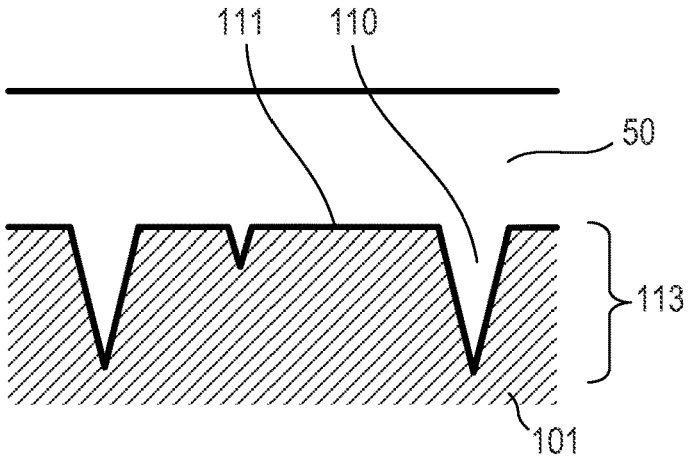
Figure 6C:
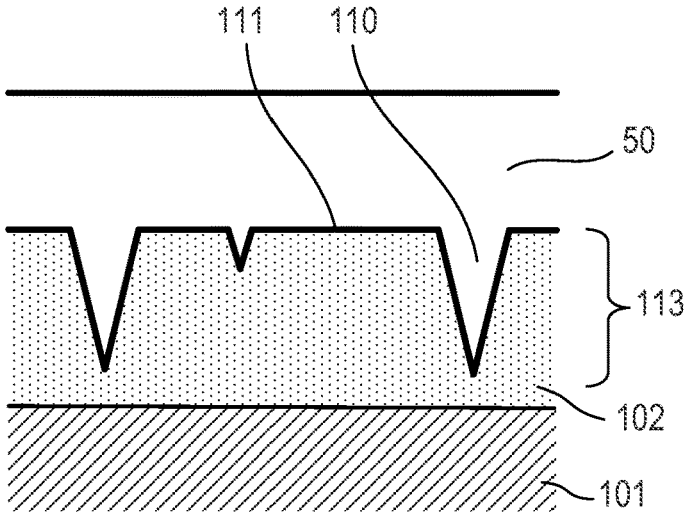

A grinding apparatus illustrated in FIGS. 6A to 6C was used to fabricate an electrophotographic belt in which the concave-convex shape 113 was formed on the base layer 101 illustrated in FIG. 1A by grinding.

As illustrated in FIG. 6A, the grinding apparatus is configured to dispose a resin-made belt 60 around an outer circumference of a column-shaped core 54 and grind a surface of the resin-made belt 60 with a grinding sheet 50. The grinding sheet 50 is looped around a feeding roller 52, an additional roller 51, and a retracting roller 53, and is configured to be pressed against the resin-made belt 60 by the additional roller 51. By feeding the grinding sheet 50 while rotating the core 54, the surface of the resin-made belt 60 is ground. FIG. 6B illustrates how this grinding apparatus machines the base layer 101, and FIG. 6C illustrates how this grinding apparatus machines a surface layer 102 in a case where the surface layer 102 is formed on the base layer 101.

The resin-made belt 60 (circumferential length 712 mm, width 260 mm) was press-fitted to the core 54 (diameter 227 mm, metallic), and the grinding sheet 50 (trade name: Lapika WA2000, from KOVAX Corporation) was caused to abut against the surface of the resin-made belt 60 by applying a pressing force (abutting surface pressure 0.08 $kg/mm^2$) to the grinding sheet 50 with the additional roller 51 (diameter 100 mm, nitrile rubber made, hardness degree 70). The hardness degree is a value according to HS K6253 standard.

Thereafter, grinding machining was performed on the surface of the resin-made belt 60 to be used as an electrophotographic belt by moving the grinding sheet 50 at a feed rate of 1.3 mm/sec while causing the grinding sheet 50 to abut against the resin-made belt 60 and by rotating the core 54 at 14 rev/min. Here, a rotating direction of the core 54 is a direction such that moving directions of the grinding sheet 50 and the core 54 abutting against each other match.

In the grinding machining, grinding sheets 50 having a surface roughness Rz of 10.0 μm were used from among three lots of grinding sheets 50. Thereafter, the evaluation of the surface shape and the cleaning evaluation were conducted as in Example 1. Results of the evaluation are shown in Table 1. In this comparative example, its height H was 17 μm, and it was determined that the convex portions 112 were not formed.

Comparative Example 2

A resin made belt 60 was fabricated in the same manner as in Comparative Example 1 except that a grinding sheet having a surface roughness Rz of 7.4 μm was used as the grinding sheet 50, and the same evaluation as in Example 1 was conducted, Results of the evaluation are shown in Table 1. In Comparative Example 2, it was determined that the convex portions 112 were not formed.

Comparative Example 3

A resin-made belt 60 was fabricated in the same manner as in Comparative Example 1 except that a grinding sheet having a surface roughness Rz of 5.9 μm was used as the grinding sheet 50, and the same evaluation as in Example 1 was conducted. Results of the evaluation are shown in Table 1. In Comparative Example 3, it was determined that the convex portions 112 were not formed.

Comparative Example 4

As the electrophotographic belt, as illustrated in FIG. 1B, an electrophotographic belt in which a surface layer 102 was formed on a base layer 101 was fabricated. As the base layer 101, the same belt body as the endless belt body in Example 1 was used, and to this belt body being the base layer 101, ultraviolet-light-curing acrylic material was applied, and the belt body was irradiated with ultraviolet light.

As a result, a curing resin film having a thickness of 2.5 μm was formed on a surface of the base layer 101, and the curing resin film was treated as the surface layer 102 of the resin-made belt 60. Then, a surface shape of the surface layer 102 was machined under the same grinding conditions as in Comparative Example 1 except that the abutting surface pressure was set at 0.12 kgf/mm$^2$. Thereafter, the same evaluation as in Example 1 was conducted on the resultant resin-made belt 60. Note that the shape and other factors belong to the surface layer 102. Results of the evaluation are shown in Table 1. In Comparative Example 4, it was determined that the convex portions 112 were not formed.

Comparative Example 5

A resin-made belt 60 was fabricated in the same manner as in Comparative Example 4 except that a grinding sheet having a surface roughness Rz of 7.4 μm used in Comparative Example 2 was used as the grinding sheet 50, and the same evaluation as in Comparative Example 4 was conducted. Results of the evaluation are shown in Table 1. In Comparative Example 5, it was determined that the convex portions 112 were not formed.

Comparative Example 6

A resin-made belt 60 was fabricated in the same manner as in Comparative Example 4 except that a grinding sheet having a surface roughness Rz of 5.9 μm used in Comparative Example 3 was used as the grinding sheet 50, and the same evaluation as in Comparative Example 4 was conducted. Results of the evaluation are shown in Table 1. In Comparative Example 6, it was determined that the convex portions 112 were not formed.

Comparative Example 7

A resin-made belt 60 was fabricated in the same manner as in Comparative Example 4 except that the grinding apparatus illustrated in FIG. 6A was used to grind a surface of a surface layer 102 ten times, and the same evaluation as in Comparative Example 4 was conducted. Results of the evaluation are shown in Table 1. In Comparative Example 7, it was determined that the convex portions 112 were not formed, and it was determined that the lands 111 were not formed, either because its land ratio L was lower than 30%.

Comparative Example 8

In Comparative Example 8, the same electrophotographic belt as in Comparative Example 4 to 6 was used, but the machining of a surface shape of its surface layer 102 was changed to the cutting machining performed with the cutting apparatus illustrated in FIG. 5A to obtain the electrophotographic belt.

The resin-made belt 60 (circumferential length 712 mm, width 260 mm) was first press-fitted to the core 54 (diameter 227 mm, metallic), and the cutting bit 91 (diamond bit, from A.L.M.T. Corp.) was caused to abut against the surface of the resin-made belt 60. Thereafter, the core 54 was rotated once at a circumferential speed of 2.2 m/sec, and then the cutting bit 91 was moved in a width direction of the resin-made belt 60 at a feed rate of 0.005 mm/sec with the core 54 caused to abut against the resin-made belt 60. In the surface shape machining, cutting conditions of the cutting bit were controlled in such a manner that the cutting bit can form sinusoidal wave forms (period 20 μm, amplitude 150 nm) with respect to the width direction of the resin-made belt 60.

After the surface shape machining, the evaluation of the surface shape and the cleaning evaluation were conducted as in Comparative Example 4, Results of the evaluation are shown in Table 1. In Comparative Example 8, it was determined that the convex portions 112 were formed but the lands 111 were not formed.

Comparative Example 9

A resin-made belt 60 was fabricated in substantially the same manner as in Comparative Example 8 except that the cutting conditions of the cutting bit 91 were changed, and the same evaluation as in Comparative Example 4 was conducted. Results of the evaluation are shown in Table 1. In Comparative Example 9, it was determined that the convex portions 112 were formed but the lands 111 were not formed.

Comparative Example 10

A resin-made belt 60 was fabricated in substantially the same manner as in Comparative Example 8 except that the cutting conditions of the cutting bit 91 were changed, and the same evaluation as in Comparative Example 4 was conducted. Results of the evaluation are shown in Table 1. In Comparative Example 10, it was determined that the grooves 110 were not formed.

Comparative Example 11

A resin made belt 60 was fabricated in substantially the same manner as in Comparative Example 8 except that the cutting conditions of the cutting bit 91 were changed, and the same evaluation as in Comparative Example 4 was conducted. Results of the evaluation are shown in Table 1. In Comparative Example 11, it was determined that the convex portions 112 were not formed.

Comparative Example 12

A resin-made belt 60 in Comparative Example 4 before subjected to the grinding machining was used as an electrophotographic belt in Comparative Example 12, in which the concave-convex shape was not formed on its surface, and the same evaluation as in Comparative Example 4 was conducted on the electrophotographic belt. Results of the evaluation are shown in Table 1, In Comparative Example 12, although it was determined that the lands 111 were formed, it was determined that neither the grooves 110 nor the convex portions 112 were formed.

Comparative Examples 13

A resin-made belt 60 was fabricated in substantially the same manner as in Comparative Example 8 except that the cutting conditions of the cutting bit 91 were changed, and the same evaluation as in Comparative Example 4 was conducted. Results of the evaluation are shown in Table 1. In Comparative Example 13, it was determined that the convex portions 112 were not formed.

Comparative Example 14

A resin-made belt 60 was fabricated in substantially the same manner as in Comparative Example 8 except that the cutting conditions of the cutting bit 91 were changed, and the same evaluation as in Comparative Example 4 was conducted. Results of the evaluation are shown in Table 1. In Comparative Example 14, it was determined that the lands 111 were not formed.

TABLE 1

| | GROOVE DEPTH | LAND RATIO | CONVEX PORTION HEIGHT | GROOVE | LAND | CONVEX PORTION | Sm | θ | Rz | CLEANING EVALUATION | | | | | |
|---|---|---|---|---|---|---|---|---|---|---|---|---|---|---|---|
| | D (nm) | L (%) | H (nm) | YN | YN | YN | (μm) | (°) | (μm) | 100K | 150K | 175K | 200K | 250K | GRADE |
| EXAMPLE 1 | 465 | 37 | 130 | Y | Y | Y | 20.2 | 90 | 0.6 | G | G | G | G | G | S |
| EXAMPLE 2 | 324 | 45 | 101 | Y | Y | Y | 20.4 | 90 | 0.43 | G | G | G | G | G | S |
| EXAMPLE 3 | 193 | 42 | 62 | Y | Y | Y | 20.1 | 90 | 0.26 | G | G | G | G | NG | A |
| EXAMPLE 4 | 380 | 32 | 110 | Y | Y | Y | 20.2 | 90 | 0.49 | G | G | G | G | G | S |
| EXAMPLE 5 | 280 | 51 | 70 | Y | Y | Y | 20.3 | 90 | 0.35 | G | G | G | G | NG | A |
| EXAMPLE 6 | 158 | 56 | 52 | Y | Y | Y | 20.1 | 90 | 0.21 | G | G | G | G | NG | A |
| EXAMPLE 7 | 102 | 49 | 99 | Y | Y | Y | 20.7 | 90 | 0.2 | G | G | G | G | NG | A |
| EXAMPLE 8 | 283 | 52 | 73 | Y | Y | Y | 20.5 | 85 | 0.36 | G | G | G | G | NG | A |
| EXAMPLE 9 | 279 | 48 | 68 | Y | Y | Y | 20.3 | 81 | 0.35 | G | G | G | NG | NG | B |
| EXAMPLE 10 | 282 | 51 | 73 | Y | Y | Y | 20.1 | 71 | 0.36 | G | G | G | NG | NG | B |
| EXAMPLE 11 | 285 | 48 | 75 | Y | Y | Y | 20.4 | 68 | 0.36 | G | G | NG | NG | NG | C |
| EXAMPLE 12 | 284 | 53 | 74 | Y | Y | Y | 20.3 | 60 | 0.36 | G | G | NG | NG | NG | C |
| EXAMPLE13 | 326 | 49 | 77 | Y | Y | Y | 3.8 | 90 | 0.38 | G | G | G | G | G | S |
| COMPARATIVE EXAMPLE 1 | 513 | 72 | 17 | Y | Y | N | 18.7 | 90 | 0.53 | G | NG | NG | NG | NG | D |
| COMPARATIVE EXAMPLE 2 | 365 | 75 | 15 | Y | Y | N | 20.5 | 90 | 0.38 | G | NG | NG | NG | NG | D |
| COMPARATIVE EXAMPLE 3 | 249 | 74 | 11 | Y | Y | N | 19.4 | 90 | 0.26 | G | NG | NG | NG | NG | D |
| COMPARATIVE EXAMPLE 4 | 561 | 71 | 19 | Y | Y | N | 16.9 | 90 | 0.58 | G | NG | NG | NG | NG | D |
| COMPARATIVE EXAMPLE 5 | 381 | 76 | 13 | Y | Y | N | 17.3 | 90 | 0.39 | G | NG | NG | NG | NG | D |
| COMPARATIVE EXAMPLE 6 | 274 | 77 | 10 | Y | Y | N | 18.4 | 90 | 0.28 | G | NG | NG | NG | NG | D |
| COMPARATIVE EXAMPLE 7 | 512 | 27 | 17 | Y | N | N | 20.1 | 90 | 0.53 | G | NG | NG | NG | NG | D |
| COMPARATIVE EXAMPLE 8 | 149 | 11 | 141 | Y | N | Y | 19.6 | 90 | 0.29 | G | NG | NG | NG | NG | D |
| COMPARATIVE EXAMPLE 9 | 432 | 28 | 92 | Y | N | Y | 20.3 | 90 | 0.52 | G | NG | NG | NG | NG | D |
| COMPARATIVE EXAMPLE 10 | 98 | 53 | 112 | N | Y | Y | 20.6 | 90 | 0.21 | G | NG | NG | NG | NG | D |
| COMPARATIVE EXAMPLE 11 | 183 | 53 | 47 | Y | Y | N | 20.2 | 90 | 0.23 | G | NG | NG | NG | NG | D |
| COMPARATIVE EXAMPLE 12 | 78 | 98 | 12 | N | Y | N | 0.1 | — | 0.09 | NG | NG | NG | NG | NG | D |
| COMPARATIVE EXAMPLE 13 | 361 | 46 | 40 | Y | Y | N | 3.5 | 90 | 0.38 | G | NG | NG | NG | NG | D |
| COMPARATIVE EXAMPLE 14 | 342 | 25 | 73 | Y | N | Y | 3.7 | 90 | 0.39 | G | NG | NG | NG | NG | D |

The land ratio L is obtained by dividing a length along the reference direction of a zone having variations in the height direction falling within the range of 20 nm by the average distance Sm of the concaves and convexes, and as described above, the average distance Sm of the concaves and convexes can be regarded as the distance S between the grooves 110. As shown in Table 1, by forming grooves having a depth D of not less than 100 nm, lands having lengths accounting for not less than 30% of the distance S between the grooves, and convex portions having a height H of not less than 50 nm, satisfactory blade cleaning lasting for a long time was enabled, satisfying a performance requirement for an electrophotographic belt.

As a result of repeating blade cleaning, the belts for electrophotography in Comparative Examples 1 to 14 all caused poor cleaning before the feeding of 150000 recording media is reached. A possible reason for the poor cleaning occurring by such a relatively low number of recording media S fed is as follows.

An outer circumferential surface of each electrophotographic belt in Comparative Examples 1 to 6, 11 and 13 has a shape such that lands 111 form a nip with the cleaning blade 11 to prevent slip-through of transfer remaining toner, and grooves 110 reduce a frictional resistance.

However, in these comparative examples, no convex portions 112 having a height H of not less than 50 nm were not formed. It is considered that this causes the nip to wear, increasing an adhered surface between an abutment portion of the blade and the outer circumferential surface of each electrophotographic belt, and this abutment portion of the blade was elongated significantly in a rotating direction of the electrophotographic belt to bring about stick slip, making it easy for transfer remaining toner to slip through the abutment portion.

In Comparative Example 7, a stable nip was not obtained because there were no lands present on the outer circumferential surface of its electrophotographic belt, and it is considered that, as a result of repeating the blade cleaning, the nip wore, and transfer remaining toner slipped through a spot where a nip region was narrow. In addition, in Comparative Example 7, since no convex portions were formed, it is considered that the adhered surface between the abutment portion of the blade and the outer circumferential surface of its electrophotographic belt was increased, and the abutment portion of the blade was elongated significantly to bring about stick slip, making it easy for transfer remaining toner to slip through the abutment portion, in the above manner.

In each of Comparative Examples 8, 9 and 14, a stable nip was not obtained because no lands were formed on the outer circumferential surface of its electrophotographic belt, and it is considered that, as a result of repeating the blade cleaning, the nip wore, and transfer remaining toner slipped through a spot where a nip region is narrow.

In Comparative Example 10, since no grooves 110 were formed on an outer circumferential surface of its electrophotographic belt, the electrophotographic belt had a shape that increased a frictional resistance produced between the cleaning blade 11 and the electrophotographic belt from the beginning. It is considered that, as a result, a nip wore by repeating the blade cleaning, which causes transfer remaining toner to slip through the nip.

In Comparative Example 11, since no convex portions were formed on an outer circumferential surface of its electrophotographic belt, it is considered that the adhered surface between the abutment portion of the blade and the outer circumferential surface of its electrophotographic belt was increased, and stick slip occurred, making it easy for transfer remaining toner to slip through the abutment portion, in the above manner.

In Comparative Example 12, since neither grooves 110 nor convex portions 112 were formed on an outer circumferential surface of its electrophotographic belt, the electrophotographic belt had a shape that increased a frictional resistance produced between the cleaning blade 11 and the electrophotographic belt from the beginning. For that reason, it is considered that a nip significantly wore when the blade cleaning was repeated, the adhered surface between the abutment portion of the blade and the outer circumferential surface of its electrophotographic belt was increased, and stick slip occurred, making it easy for transfer remaining toner to slip through the abutment portion, in the above manner.

In contrast, the outer circumferential surface of the electrophotographic belt according to the present disclosure is provided not only the grooves 110 but also the lands 111 and the convex portions 112. The lands 111 form a nip between the cleaning blade 11 and the electrophotographic belt to prevent slip-through of transfer remaining toner.

The grooves 110 reduce a frictional resistance produced between the cleaning blade 11 and the electrophotographic belt. The convex portions 112 each have a shape that lifts the cleaning blade 11 to restrain excessive adhesion (stick) to the electrophotographic belt. As a result, with the electrophotographic belt according to the present disclosure, occurrence of the stick slip is kept low, and as described in Examples 1 to 13, the poor cleaning does not occur even at a time of feeding 150000 recording media.

Here, an influence of the angle θ formed by the direction in which the grooves 110 extend and the longitudinal direction of the abutment nip 115 made by the cleaning blade 11 will be discussed. As shown in Table 1, in a case where this angle θ is not less than 60°, poor cleaning did not occur at a time of feeding 150000 recording and in a ease where this angle θ is not less than 71°, poor cleaning did not occur at a time of feeding 175000 recording media. In particular, in a case where this angle θ is not less than 85°, poor cleaning did not occur at a time of feeding 200000 recording media.

This is considered to be due to setting the angle θ at the right angle or an angle close to the right angle ($60° \leq \theta \leq 90°$), so that a force by which the abutment nip climbs over a side wall portion of a convex portion 112 higher than lands 111 adjacent to grooves 110 is kept low, which reduces the wearing of the nip portion. As long as the wearing of the nip portion is reduced, it is expected that the slip-through of transfer remaining toner can be reliably restrained for a long time, and a good blade cleaning property is attained. According to the results of the examples, θ is preferably set at 71° or larger and 90° or smaller, still more preferably from 85° to the right angle.

Next, importance of forming the convex portions 112 will be further described based on results of observations. On each of Examples 1 to 13 described above, the cleaning evaluation after feeding 250000 recording media, and after the cleaning evaluation on each example, the cleaning blade 11 and the electrophotographic belt 5 were observed.

As a result, in Examples 3 and 5 to 12, in which the slip-through of transfer remaining toner was recognized at a time of feeding 250000 recording media, their cleaning blades 11 were observed wearing. In contrast, in Examples 1, 2, 4 and 13 in which the slip-through of transfer remaining toner was not recognized even at a time of feeding 250000 recording media, grooves 110 of their belts for electrophotography 5 were observed to be left while partially covered with paper dust and external additive of toner. From these results of the observation, it is considered that the grooves 110 left reduced the increase in a contact area between the cleaning blade 11 and the endless-shaped electrophotographic belt 5, which restrained the increase in the frictional force and reduced the wearing of the cleaning blade 11. It is considered that, as a result of the reduction in the wearing in this manner, no poor cleaning occurred even after feeding 250000 recording media in Examples 1, 2, 4 and 13, that is, Examples 1, 2, 4 and 13 were rated as Grade S, the highest quality.

Figure 7A:
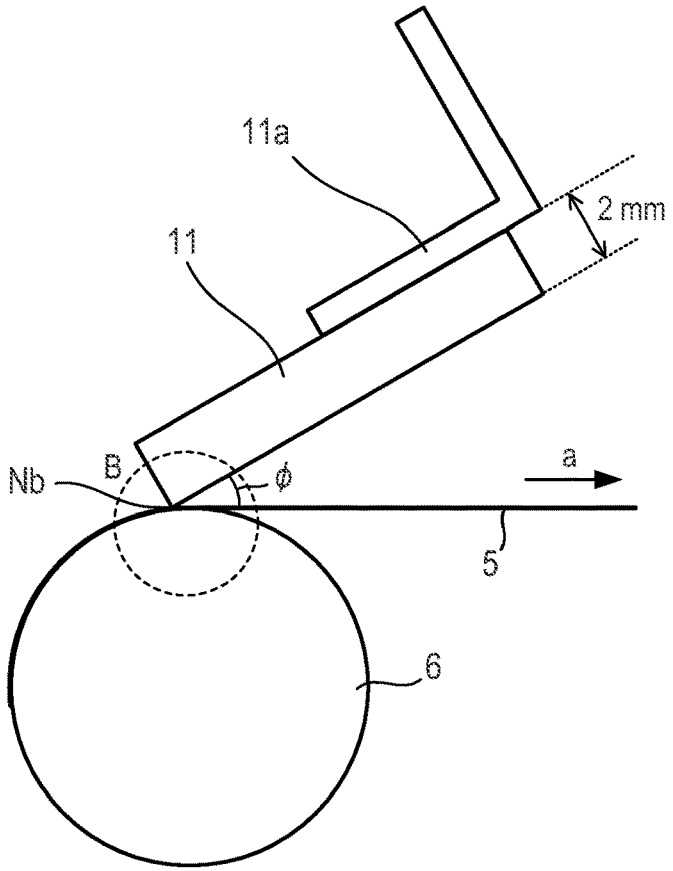
FIGS. 7A and 7B are diagrams each illustrating a contact portion between an electrophotographic belt and a cleaning blade.
Figure 7B:
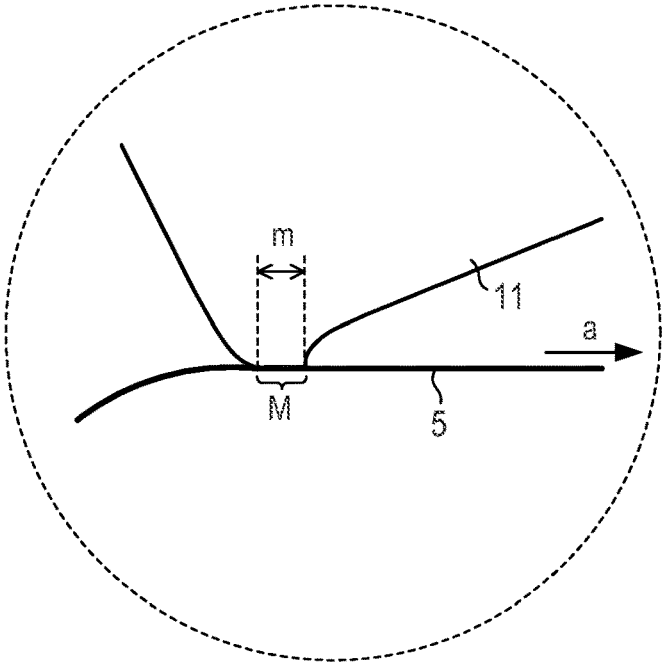

FIG. 7A is a diagram illustrating a vicinity of a position at which the electrophotographic belt 5 and the cleaning blade 11 viewed from a direction of a rotation axis of the tension roller 6, and FIG. 7B is an enlarged view of a portion indicated by a broken line B in FIG. 7A.

In FIG. 7A and FIG. 7B, the intrusion amount d of the cleaning blade 11 is drawn smaller than its actual size, for convenience of illustration. The cleaning blade 11, which is made of an elasticity body and have a thickness of, for example, 2 mm, is attached to a mounting bracket 11*a* having an L-shaped cross section.

In FIG. 7A, reference character Nb indicates the abutment nip that is formed between the cleaning blade 11 and the outer circumferential surface of the electrophotographic belt 5. As illustrated in FIG. 7A and FIG. 7B, the cleaning blade 11 is disposed pointing in a counter direction to the rotating direction a of the endless-shaped electrophotographic belt 5. Therefore, a leading edge portion of the cleaning blade 11 to come into contact with the electrophotographic belt 5 receives a frictional force opposite to a belt conveyance direction. The frictional force received by the leading edge portion of the cleaning blade 11 serves as a force that causes the leading edge portion of the cleaning blade 11 to bend to follow in a belt conveyance direction. As a result, the frictional force acting on the contact portion curves a contact portion of the cleaning blade 11 as illustrated in FIG. 7B, which forms a caught portion M. In the caught portion M, the cleaning blade 11 is in contact with the electrophotographic belt 5 in a form of a surface. A length of the caught portion lvi in the belt conveyance direction is indicated as m in the diagram.

The wearing of the cleaning blade 11 will be discussed. In a case where the grooves 110 are buried in paper dust and the like, a substantial contact area between the cleaning blade 11 and the electrophotographic belt 5 increases. The increase in the contact area is considered to hinder a proper caught portion M from being kept and bring about a stick slip phenomenon, leading to the wearing of the cleaning blade 11. It is therefore considered that, if the grooves 110 are not buried even after the test about the cleaning performance described above including a large number of repetitions, the contact area in the cleaning blade 11 is not increased, the proper caught portion M is kept, and therefore the wearing of the blade can be ameliorated. From this viewpoint, in order to obtain a durability as a product life that allows the feeding of more than 200000 recording media, it is necessary to further increase the depth D of the grooves 110 to reduce the burying of the grooves 110 in the paper dust and the external additive. In a case where the convex portions 112 are formed on the surface of the electrophotographic belt 5, it is considered that the depth D of the grooves can be set at not less than 0.40 μm to reduce the burying of the grooves 110 and in turn prevent the wearing of the cleaning blade 11.

In a case where the grooves 110 are formed on the surface of the electrophotographic belt 5 by causing the mold to abut against the surface, it is necessary to increase the abutting surface pressure of the mold for increasing the depth D of the grooves. As with the belts for electrophotography 5 in Examples 4 to 6, in a configuration in which an ultraviolet light curing acrylic material is applied to a surface layer, the surface layer is hard, and thus if the abutting surface pressure of the mold is increased, a crack can be created on the surface layer in forming the grooves 110. The creation of the crack on the surface layer can be prevented by adjusting the abutting surface pressure, but this case fails to obtain a sufficient depth D of the grooves.

According to the molds made by the present inventors seeing the durability that allows the feeding of more than 200000 recording media, it was found that the wearing of the blade is further restrained by forming the convex portions 112 on both sides of each groove 110. Specifically, a land 111 is formed at a position between every adjacent two grooves 110, and in addition, convex portions 112 are formed between the land 111 and the two grooves 110 adjacent to the land 111. With such a configuration, an effective depth of the grooves 110 regarding the burying can be considered to be a sum of the height H of the convex portions 112 and the depth D of the grooves defined as described with reference to FIG. 1A to FIG. 1C. Therefore, the effective depth can be made large as compared with an actual depth D of the grooves 110 formed by the mold, which enables the wearing of the blade to be reduced while decreasing the abutting surface pressure of the mold to form the grooves 110. The sum of the depth D of the grooves and the height H of the convex portions of each of Examples 1 to 13 was calculated as: 595 nm in Example 1, 425 nm in Example 2, 490 nm in Example 4 and 403 mu in Example 13. In contrast, in each of Examples 3 and 5 to 12, the sum of the depth D of the grooves and the height H of the convex portions was not more than 360 nm. In each of Examples 1 to 13, the height H of the convex portions fell within a range from 24% to 97% of the depth D of the grooves. This means that the effective depth of the grooves 110 fell within a range from 124% to 197% of the depth D of the grooves, and thus an optimal effective depth could be obtained for a necessary product life even when the abutting surface pressure of the mold was decreased.

Note that the present disclosure is not limited to the above-described embodiment and examples and can be modified into variations based on the gist of the present disclosure, and the variations should not be excluded from the scope of the present disclosure.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2019-084092, filed Apr. 25, 2019, which is hereby incorporated by reference herein in its entirety.

What is claimed is:

1. An electrophotographic belt having an endless shape, comprising, on an outer circumferential surface thereof, grooves and lands, the grooves extending in a circumferential direction of the electrophotographic belt, the lands being positioned between the grooves, wherein the electrophotographic belt further has on the outer circumferential surface, one or more convex portion(s)

between at least one of the grooves and one of the lands adjacent to the one of the grooves, and in a cross section of the electrophotographic belt in a direction orthogonal to a direction of which the grooves extend, the convex portion(s) projects more than the lands, and wherein each of the lands is an area positioned between two of the adjacent grooves, the area having a width in a direction orthogonal to the direction of which the grooves extend of 30% of an interval of the two adjacent grooves, and having a surface whose variations in a height direction falls within a range of 20 nm.

2. The electrophotographic belt according to claim 1, wherein the outer circumferential surface has a surface roughness Rz according to Japanese Industrial Standards (JIS) B 0601 (2001) of 0.2 μm or higher and 0.6 μm or lower, and with respect to a surface of the land, a depth of the grooves is not less than 100 nm, and with respect to the surface of the land, a height of the convex portions is not less than 50 nm.

3. The electrophotographic belt according to claim 1, wherein in a cross section orthogonal to the direction of which the grooves extend, the convex portions are positioned between each of grooves and each of the lands adjacent to each of the grooves.

4. An electrophotographic image forming apparatus comprising an electrophotographic belt and a cleaning blade configured to abut against an outer circumferential surface of the belt, wherein the electrophotographic belt has an endless shape, comprises, on an outer circumferential surface thereof, grooves and lands, the grooves extending in a circumferential direction of the electrophotographic belt, the lands being positioned between the grooves, wherein the electrophotographic belt further has on the outer circumferential surface, one or more convex portion(s) between at least one of the grooves and one of the lands adjacent to the one of the grooves, and in a cross section of the electrophotographic belt in a direction orthogonal to a direction of which the grooves extend, the convex portion(s) projects more than the lands, and wherein the cleaning blade is so provided as to intersect with the grooves at an abutment nip of the cleaning blade and the outer circumferential surface of the electrophotographic belt, and wherein a longitudinal direction of the abutment nip and an extending direction of the grooves form an angle of 60° or larger and 90° or smaller.

5. The electrophotographic image forming apparatus according to claim 4, wherein a longitudinal direction of the abutment nip and an extending direction of the grooves form an angle of 90°.

* * * * *